US012648678B2

(12) United States Patent
Hassfurter et al.

(10) Patent No.: US 12,648,678 B2
(45) Date of Patent: Jun. 9, 2026

(54) FLOOR CLEANER WITH A MOVABLY MOUNTED SUCTION NOZZLE

(71) Applicant: BSH Hausgeräte GmbH, Munich (DE)

(72) Inventors: Stefan Hassfurter, Maroldsweisach (DE); Frank Schnitzer, Bad Neustadt (DE); Julius Geis, Burkardroth (DE); Dominik Schreiner, Kalbach (DE)

(73) Assignee: BSH Hausgeräte GmbH, Munich (DE)

( * ) Notice: Subject to any disclaimer, the term of this patent is extended or adjusted under 35 U.S.C. 154(b) by 413 days.

(21) Appl. No.: 18/492,260

(22) Filed: Oct. 23, 2023

(65) Prior Publication Data

US 2024/0130583 A1 Apr. 25, 2024
US 2024/0225388 A9 Jul. 11, 2024

(30) Foreign Application Priority Data

Oct. 24, 2022 (DE) ..... 10 2022 211 259.8

(51) Int. Cl.

| | |
|---|---|
| ***A47L 9/06*** | (2006.01) |
| ***A46B 9/02*** | (2006.01) |
| ***A46B 13/00*** | (2006.01) |
| ***A46B 13/02*** | (2006.01) |

(Continued)

(52) U.S. Cl.

CPC ..... *A47L 9/066* (2013.01); *A46B 9/025* (2013.01); *A46B 9/026* (2013.01); *A46B 13/001* (2013.01); *A46B 13/02* (2013.01); *A47L 9/0072* (2013.01); *A47L 9/009* (2013.01); *A47L 9/0477* (2013.01); *A47L 9/0626* (2013.01); *A46B 2200/3033* (2013.01)

(58) Field of Classification Search

CPC ..... A47L 5/34; A47L 9/0494; A47L 9/066; A47L 11/4052; A47L 11/4058

See application file for complete search history.

(56) References Cited

U.S. PATENT DOCUMENTS 3,391,418 A * 7/1968 Jonsson ..... A47L 9/0411 15/325
4,976,003 A * 12/1990 Williams ..... A47L 9/0494 15/372
7,246,405 B2 7/2007 Yan (Continued)

FOREIGN PATENT DOCUMENTS

DE 202004002284 U1 7/2004
DE 102010000577 A1 8/2011

(Continued)

*Primary Examiner* — Courtney D Heinle
*Assistant Examiner* — Danielle M. Christensen
(74) *Attorney, Agent, or Firm* — Laurence A. Greenberg; Werner H. Stemer; Ralph E. Locher

(57) ABSTRACT

A floor vacuum cleaner for cleaning a floor surface has a chassis with a chassis frame for traveling over the floor surface. A suction nozzle aspirates an airflow in the region of the floor surface. The suction nozzle is mounted relative to the chassis in the direction of travel to the front left and front right in each case by way of a mounting arrangement formed of a journal and a guide. The mounting arrangement allows a tilting of the suction nozzle about the journals, a rotation of the suction nozzle about a longitudinal axis, and a vertical movement of the suction nozzle, but a movement of the suction nozzle in the longitudinal direction of the chassis is prevented.

10 Claims, 5 Drawing Sheets

(51) Int. Cl.
*A47L 9/00* (2006.01)
*A47L 9/04* (2006.01)

(56) References Cited

U.S. PATENT DOCUMENTS

| | | | |
|---|---|---|---|
| 9,661,971 | B2 | 5/2017 | Riehl |
| 2012/0096656 | A1 | 4/2012 | Jung et al. |

FOREIGN PATENT DOCUMENTS

| | | | | | |
|---|---|---|---|---|---|
| DE | 102014112313 | A1 * | 3/2015 | ..... | A47L 9/0494 |
| EP | 2116165 | A2 * | 11/2009 | ..... | A47L 9/0494 |

* cited by examiner

FLOOR CLEANER WITH A MOVABLY MOUNTED SUCTION NOZZLE

CROSS-REFERENCE TO RELATED APPLICATION

This application claims the priority, under 35 U.S.C. § 119, of German Patent Application DE 10 2022 211 259.8, filed Oct. 24, 2022; the prior application is herewith incorporated by reference in its entirety.

FIELD AND BACKGROUND OF THE INVENTION

The invention relates to an automatic floor cleaner with a suction facility. The invention relates, in particular, to the mounting of the suction nozzle relative to a chassis of the floor cleaner.

A floor vacuum cleaner is designed to travel over a floor surface and to clean it at the same time. To this end, the floor vacuum cleaner comprises a suction facility which produces an airflow through a suction nozzle that is attached to a chassis of the floor vacuum cleaner. The suction nozzle is configured to be positioned at a predetermined spacing from the floor surface so as not to impede a horizontal entry of large particles of dirt or foreign bodies. However, the spacing should not be too great, in order to be able to use the airflow efficiently for picking up dirt.

If the suction nozzle is rigidly attached to the chassis it can run against an obstacle and impede the movement of the floor vacuum cleaner. If the suction nozzle is arranged so as to be vertically movable, the spacing from the floor surface, for example when traveling over an edge or threshold, can be temporarily too small or too great. Various proposals have been made regarding the movable mounting of a suction nozzle relative to a chassis.

German published patent application DE 10 2010 000 577 A1 relates to a floor vacuum cleaner with a suction nozzle which is pivotably mounted at a rear end relative to the direction of travel. A guide consisting of a sliding guide and a sliding block is provided at a front end in order to permit a vertical movement. The front end on the chassis is pushed by means of a coil spring in the direction of the floor surface. The pick-up of large particles of material in the region of the suction nozzle can be impeded thereby.

BRIEF SUMMARY OF THE INVENTION

It is an object underlying the present invention to provide an improved technique for flexibly attaching a suction nozzle to a floor vacuum cleaner.

With the above and other objects in view there is provided, in accordance with the invention, a floor vacuum cleaner for cleaning a floor surface, the floor vacuum cleaner comprising:

- a chassis with a chassis frame for traveling on the floor surface, the chassis defining a longitudinal direction and a longitudinal axis;
- a suction nozzle for an intake of an airflow at the floor surface;
- the suction nozzle being mounted relative to the chassis by respective mounting arrangements at a front left and a front right of the chassis in a direction of travel, the mounting arrangements including a journal and a guide configured to enable a tilting of the suction nozzle about the journals, a pivoting of the suction nozzle about the longitudinal axis, and a vertical movement of the suction nozzle, but to prevent a movement of the suction nozzle in the longitudinal direction of the chassis.

In other words, the objects of the invention are achieved by a floor vacuum cleaner for cleaning a floor surface. The device comprises a chassis with a chassis frame for traveling over the floor surface; and a suction nozzle for the intake of an airflow in the region of the floor surface, wherein the suction nozzle is mounted relative to the chassis in the direction of travel to the front left and right in each case by means of an arrangement consisting of a journal and a guide such that a tilting of the suction nozzle about the journals, a rotation of the suction nozzle about a longitudinal axis and a vertical movement of the suction nozzle are made possible, but a movement of the suction nozzle in the longitudinal direction of the chassis is prevented.

Due to this mounting, the suction nozzle can be held in an improved manner in an advantageous position relative to the substrate. When traveling over an uneven portion, the suction nozzle can still be held such that dirt is effectively picked up from the floor surface. When traveling over a threshold or step, a transition between various floor coverings, a cable, a joint or a different obstacle, the suction nozzle can be guided along the substrate in an improved manner. The suction nozzle can be movable in three predetermined degrees of freedom, wherein a first degree of freedom relates to a tilting of the suction nozzle about a transverse axis of the floor vacuum cleaner, a second degree of freedom relates to a pivoting about a longitudinal axis and a third degree of freedom relates to a displacement along a height axis.

Optionally, the suction nozzle can also be displaced along a transverse axis of the chassis. A resilient element can counteract a displacement from a predetermined position. Restoring forces of the resilient element can be the same or different for a displacement to the left and to the right. To this end, an arrangement with two different resilient elements can be used. The displacement can be limited on one side or two sides to a predetermined path.

Large particles of dirt can enter the region of the suction nozzle and can be suctioned up or aspirated in an improved manner from the floor surface by the combination of the described degrees of freedom. It is possible to avoid the situation where the floor vacuum cleaner becomes stuck on an edge or digs into a soft or deep-pile substrate.

In a preferred embodiment, a journal is provided on the suction nozzle and a guide is provided on the chassis. As a result, a vertical guidance of the journal can be improved. The journals extend along a common axis and can be configured in the manner of trunnions on either side of the suction nozzle. The receiver can be formed by two bearing surfaces which are parallel to one another and which in each case extend perpendicularly to the longitudinal axis of the chassis. A bearing surface can be as narrow as desired; in one embodiment, for example, a vertical cylinder can form the bearing surface. A reverse arrangement in which a journal is provided on the chassis and a receiver is provided on the suction nozzle can also be used.

Further preferably, the suction nozzle is mounted so as to be vertically movable to the rear left and right. A separate guide in this region is not required. The mobility of the suction nozzle can thus be defined as extensive.

In a simple embodiment, a vertical position of the suction nozzle at the rear end is limited by a weight force of the suction nozzle or a component connected thereto. In a preferred embodiment, it is possible to provide a resilient element which is designed to push a rear end of the suction nozzle into a predetermined vertical position relative to the chassis. In each case a resilient element can be provided at a rear left end and a rear right end. A resilient element can act both upwardly and downwardly, wherein the effective spring constants can be the same or different. At the front end a resilient element can be dispensed with; the vertical position preferably being able to be set here due to the weight force of the suction nozzle or in the extension of the rear end.

The resilient element can be formed by a resilient tubular connecting piece through which the airflow flows from the suction nozzle in the direction of the suction facility. The tubular connecting piece is further preferably located on the suction nozzle to the rear in the direction of travel and runs approximately horizontally. The resilience of the tubular connecting piece can be used for positioning the suction nozzle and can assist with the elimination of a separate resilient element. The tubular connecting piece can be designed such that in each case it provides predetermined resilient forces relative to a rotation about a longitudinal axis (second degree of freedom) and a vertical deflection of the suction nozzle (third degree of freedom). These forces can be determined to a certain extent independently of one another by the shape and choice of material of the suction nozzle.

In yet a further preferred embodiment, a deflection of a rear end of the suction nozzle upwardly and/or downwardly from the predetermined position is limited to a predetermined path. A deflection path upwardly can be greater than a deflection path downwardly. For example, the suction nozzle can be deflected upwardly relative to the chassis by approx. 4.5 mm and deflected downwardly by approx. 2.3 mm before a stop limits the movement.

A deflection of the front end of the suction nozzle upwardly can be limited to a further predetermined value. This deflection path can be shorter than a deflection path of the rear end upwardly or downwardly. In one embodiment, the front end can be deflected upwardly by approximately 1-2 mm. A deflection downwardly can not be provided or can be zero.

In another preferred embodiment, a brush roller with an axis of rotation running transversely to the direction of travel is attached in the suction nozzle. The brush roller can be rotated by means of a drive motor about the axis of rotation and it is designed to release or loosen dirt from the floor surface or to guide the dirt in the region of the suction nozzle. A contact of the brush roller with the substrate can be improved by the proposed floating bearing of the suction nozzle, such that the floor surface can be cleaned in an improved manner by means of the brush roller.

A sealing lip can be provided in the region of a rear end of the suction nozzle. The sealing lip preferably extends in the transverse direction and is designed as far as possible to bear against the floor surface and to seal the suction nozzle relative to the floor surface. To this end, the sealing lip is preferably manufactured from a resilient material, so that if required the sealing lip can be resiliently deformed on an obstacle or an uneven portion on the floor surface. A sealing action of the sealing lip relative to the floor surface can be further improved by the described mobility of the suction nozzle relative to the chassis.

A sliding element can be provided for supporting a rear end of the suction nozzle relative to the floor surface. The sliding element can have a surface made of plastics or textile material (thread lifter). If a sealing lip is provided, the sliding element still remains downstream of the sealing lip relative to the direction of travel.

The chassis frame may include a drive wheel and a control device in order to control a movement of the floor vacuum cleaner over the floor surface. The floor vacuum cleaner is preferably provided for the autonomous treatment of a floor surface. The floor surface is further preferably contained within a household and, for example, can relate to one or more rooms.

Other features which are considered as characteristic for the invention are set forth in the appended claims.

Although the invention is illustrated and described herein as embodied in a floor cleaner with a movably mounted suction nozzle, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
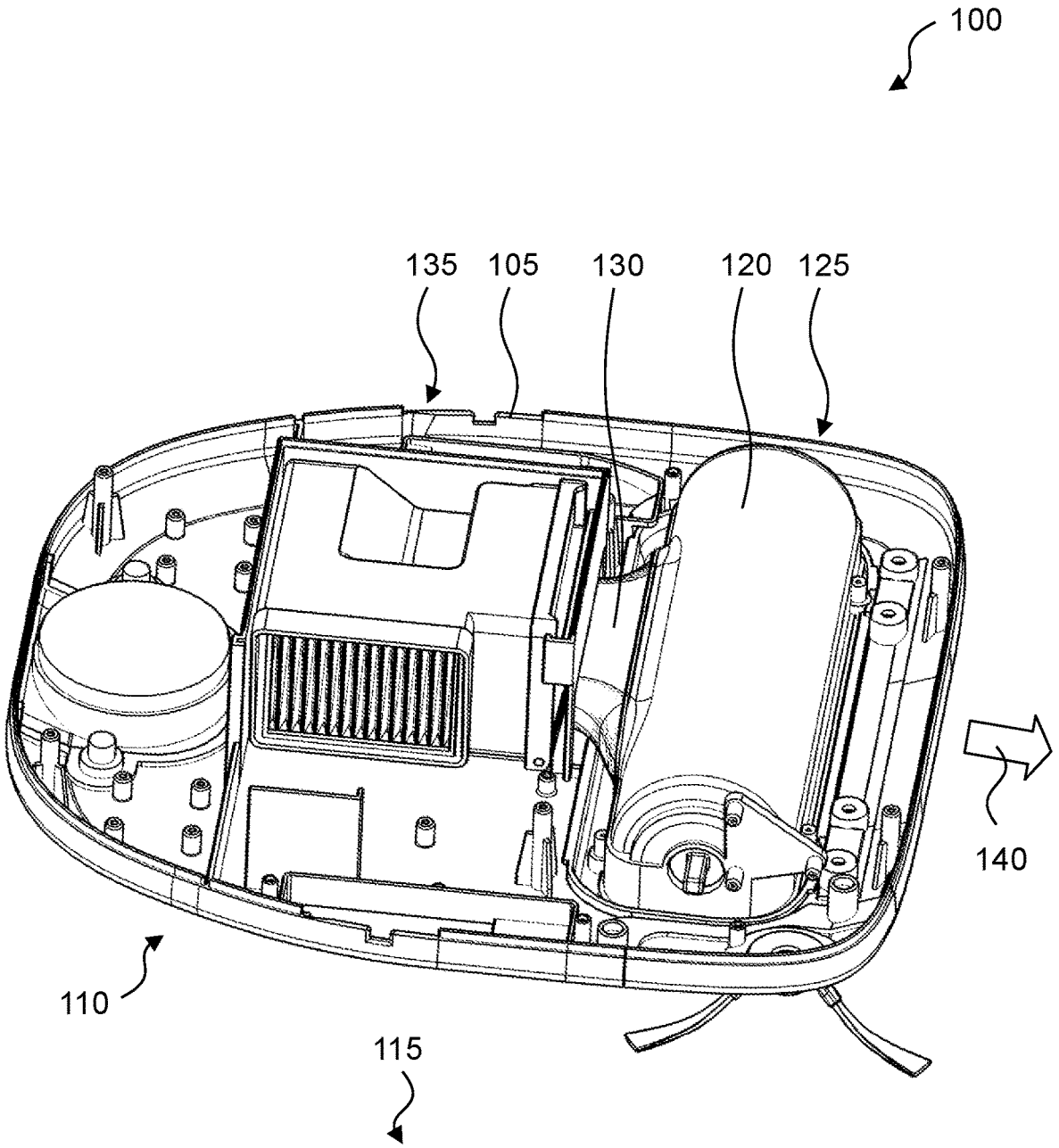
FIG. 1 is a perspective view of a floor vacuum cleaner.

Referring now to the figures of the drawing in detail and first, in particular, to FIG. 1 thereof, there is shown an exemplary floor vacuum cleaner 100. An upper part of a housing and several elements which are not relevant for the presentation of the invention are omitted from the illustration. The floor vacuum cleaner 100 comprises a chassis 105 with a driven chassis frame 110 which is designed to support the chassis 105 relative to a floor surface 115. Preferably, the chassis frame 110 comprises at least one drive wheel which is driven by means of a drive motor. Moreover, a control device is provided for controlling the drive motor and/or a steering system. The control device is preferably designed to control an autonomous movement of the floor vacuum cleaner 100 on the floor surface 115. During operation, the floor vacuum cleaner 100 can be activated to travel over, and at the same time to treat, a predetermined portion of the floor surface 115.

A suction nozzle 120 is provided for treating the floor surface 115, in the present case a brush roller 125 with a horizontal axis of rotation being arranged therein. The suction nozzle 120 is connected via a tubular connecting piece 130 to a suction facility 135 which is preferably arranged downstream of the suction nozzle 105 relative to a direction of travel 140. The suction facility 135 is not directly visible in FIG. 1. It is located in the filter housing. The suction nozzle 120 forms a chamber with a rear opening, which is connected to the tubular connecting piece 130, and a lower opening through which a portion of the brush roller 125 can protrude and through which an airflow can enter. The brush roller 125 can be driven by means of a drive motor (not shown) about the axis of rotation, in order to treat the floor surface 115 mechanically. The suction nozzle 120 is movable relative to the chassis 105 and can be pushed relative thereto into a predetermined position by means of its own weight force or by means of a resilient element. Preferably, edges on the lower face of the suction nozzle 120 are designed to be rounded or chamfered in order to deflect the suction nozzle 120 upwardly in an improved manner when it comes into contact with an obstacle on the floor surface 115.

Figure 2:
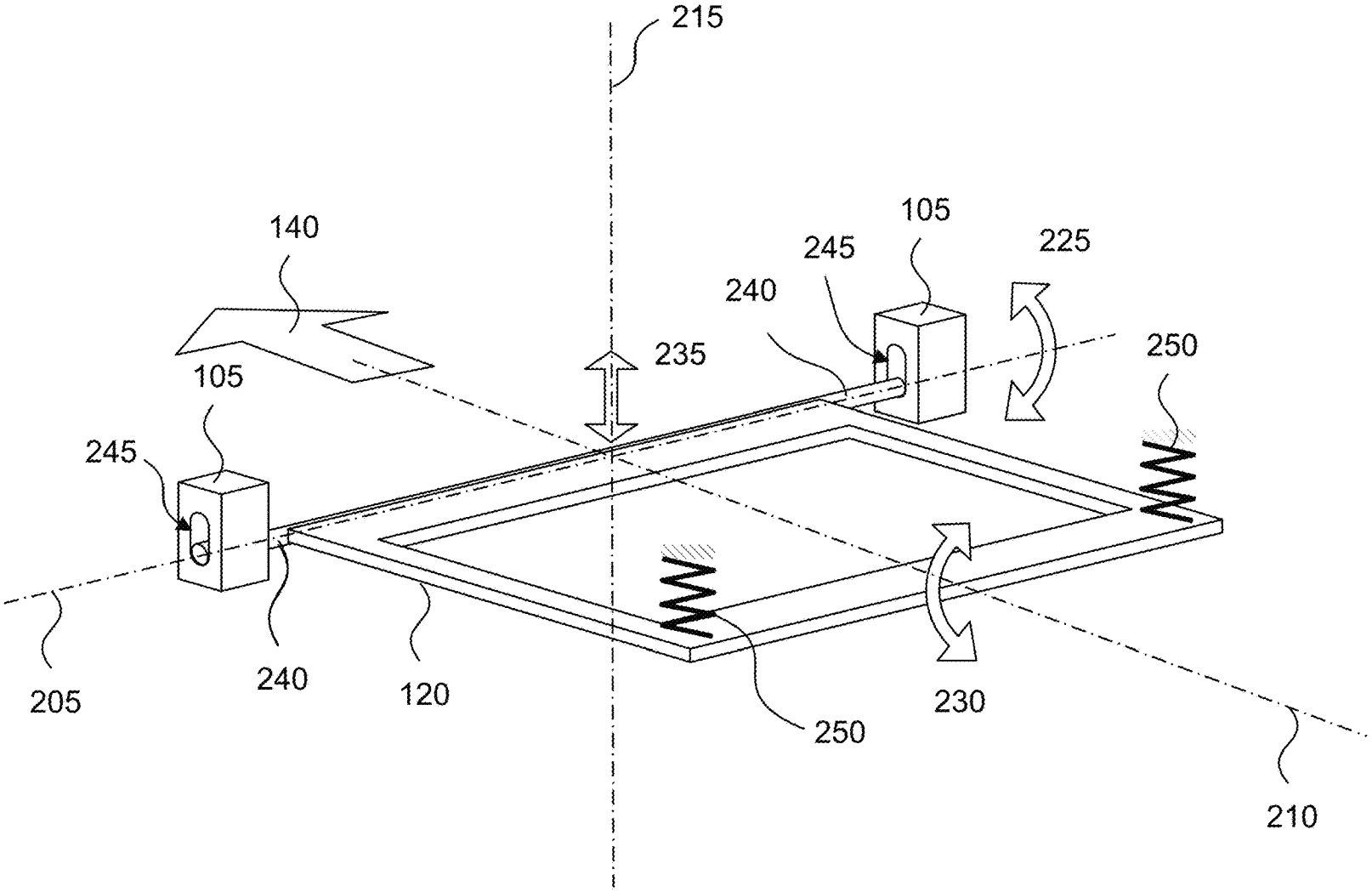
FIG. 2 shows a basic sketch of a floating bearing of a suction nozzle.

The suction nozzle 120 is movably mounted relative to the chassis 105, which is explained in more detail with reference to FIG. 2. FIG. 2 shows a schematic view of the mounting of the suction nozzle 120 on the chassis 105. The suction nozzle 120 is shown as a frame in simplified form and the chassis 105 is shown as two bearing points in simplified form.

A transverse axis 205, a longitudinal axis 210 and a height axis 215 which preferably form a right-handed coordinate system are defined relative to the chassis 105. The suction nozzle 120 can be tilted about the transverse axis 205 which corresponds to a first degree of freedom 225. The suction nozzle 120 can be pivoted about the longitudinal axis 210 which corresponds to a second degree of freedom 230. The suction nozzle 120 can be displaced along the height axis 215 which corresponds to a third degree of freedom 235. Movements of the suction nozzle in the degrees of freedom 225 to 235 can be coupled together in a predetermined manner.

In the embodiment shown, a movement along the transverse axis 205 is made possible by lateral spacings between the suction nozzle 120 and the bearing points on a predetermined path. A resilient element can cause a return into a predetermined position when the suction nozzle 120 is horizontally deflected. The resilient element can be assigned to this movement. In a further embodiment, this movement is prevented, for example, by the afore-mentioned spacings being virtually zero. The suction nozzle 120 is preferably immovable along the longitudinal axis 210. A rotation about the height axis 215 is preferably also prevented. Overall, in this manner the suction nozzle 120 is movable in 4 or 3 degrees of freedom and immovable in the remaining 2 or 3 degrees of freedom.

One respective journal 240 is attached to the suction nozzle 120 to the front left and right with reference to the direction of travel 140. The journals 240 extend along a common axis of rotation. In the schematic view shown, the journals 240 form part of a continuous axis, in a further embodiment the axis can also be interrupted. That is, the journals 240 may be in the form of trunnions at the left and right of the forward edge of the suction nozzle 120. Each journal 240 is received on the chassis 105 in a receiver 245 which prevents a movement of the journal 240 in the direction of the longitudinal axis 210, whereby a rotation of the suction nozzle 120 about the height axis 215 is also prevented. The journal 240 and the receiver 245 with a vertical slot form mounting arrangements for the forward end of the suction nozzle 120. A movement of the suction nozzle 120 along the height axis 215 is possible to a predetermined extent. The receiver 245 is formed with a vertical slot in the bearing position shown, wherein a journal 240 extends through the slot. The boundaries of the slot determine a maximum deflection of the journal 240 or the suction nozzle 120 upwardly and downwardly. A tilting of the suction nozzle 120 about the longitudinal axis 210 is also made possible by the independent mounting of the two journals 240.

Relative to the direction of travel 140, one respective resilient element 250 is provided to the rear left and right in order to bias the suction nozzle 120 in this region into a predetermined position. Optionally a resilient element 250 is dual-acting, or two resilient elements 250 which act in an antiparallel manner are provided, so that a deflection of the suction nozzle 120 from the predetermined position both upwardly and downwardly is counteracted by a corresponding restoring force. At the same time, the spring hardness can be the same or different in the two directions. The resilient element 250 can be pretensioned so that a deflection of the suction nozzle 120 from the predetermined position requires a predetermined minimum force.

Resilient elements 250 can also be provided on the journals 240 or a vertical position of the suction nozzle 120 can be primarily determined in this region by a weight force on the suction nozzle 120.

Figure 3:
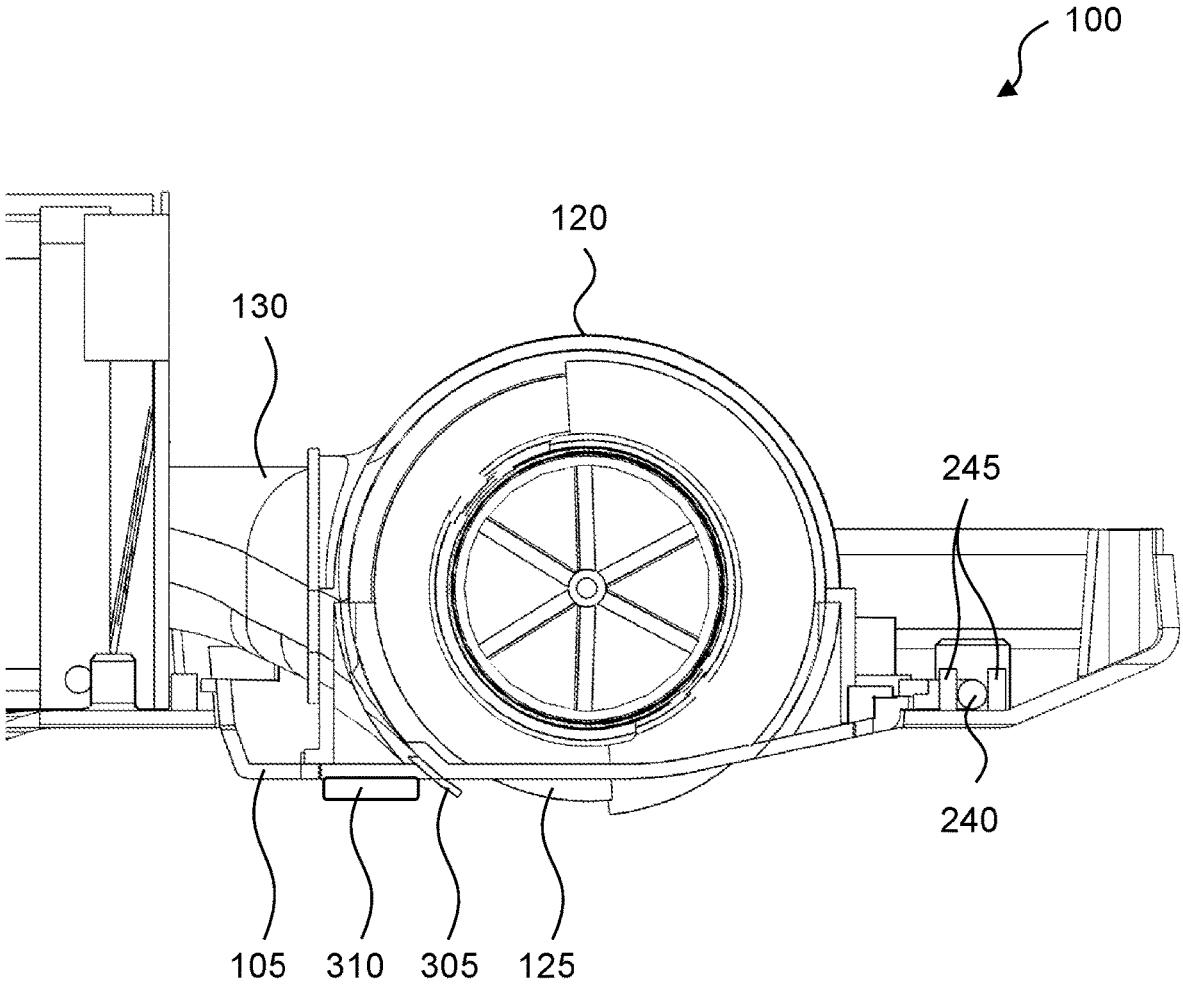
FIG. 3 shows a longitudinal section through a floor vacuum cleaner.

FIG. 3 shows a longitudinal section through an exemplary floor vacuum cleaner 100. In the position shown, the journals 240 are positioned at the bottom on the receivers 245 or on the chassis 105. In the rear region, the suction nozzle 120 is attached by the tubular connecting piece 130 relative to the chassis 105 or the suction facility 135 which is fastened to the chassis 105. The tubular connecting piece 130 is manufactured from a flexible material, preferably from plastic, for example from an elastomer.

Resilient properties of the tubular connecting piece 130 can be influenced by its shape, its wall thickness or its material. A resilient force which is brought about by the tubular connecting piece 130, when it is subjected to shear when the suction nozzle 120 is pivoted about the transverse axis 205, can be determined irrespective of a resilient force which it exerts when the suction nozzle 120 is rotated about the longitudinal axis 210. For example, a stiffness of the tubular connecting piece 130 counter to a rotation about the longitudinal axis 210 can be lower when a cross section of the tubular connecting piece 130 is designed to be oval or flat, and higher when its cross section is designed to be round.

A sealing lip 305 which preferably extends parallel to the transverse axis 205 is attached to the suction nozzle 120 downstream of the brush roller 125. A sliding element 310, which is designed to be positioned on the floor surface 115 or to slide thereover, is also preferably attached to the suction nozzle 120 downstream of the sealing lip 305.

Figure 4:
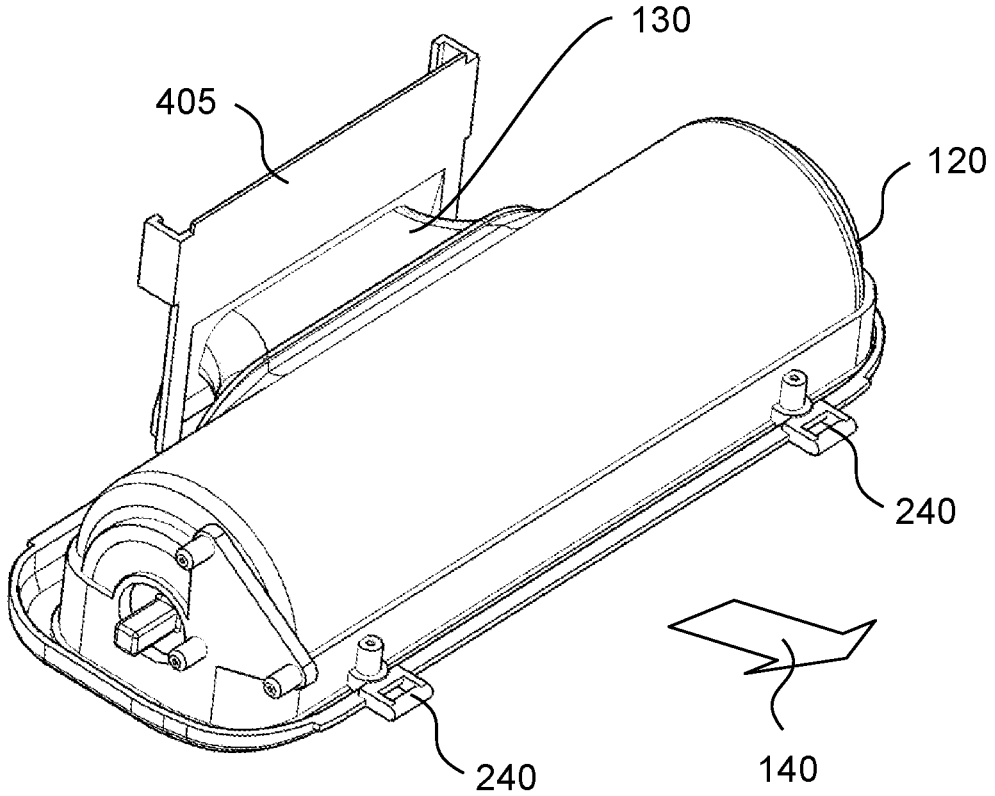
FIG. 4 is a first perspective view of a suction nozzle of a floor vacuum cleaner.
Figure 5:
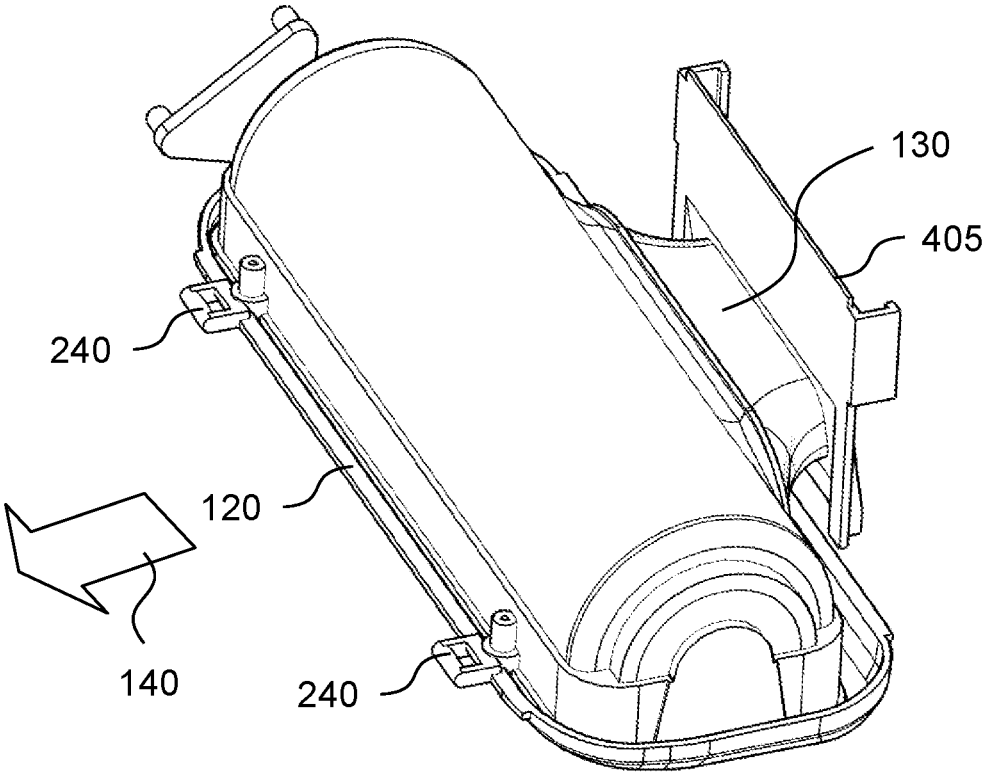
FIG. 5 is a second perspective view a suction nozzle of a floor vacuum cleaner.

FIGS. 4 and 5 show views of a suction nozzle 120 in an exemplary embodiment. It can be identified that the journals 240 are placed here on the suction nozzle 120 upstream of a boundary of the region through which air flows. The tubular connecting piece 130 has a horizontally flattened cross section here. A flange 405 can be provided at a rear end of the tubular connecting piece 130, for attaching to the chassis 105 or the suction facility 135.

Figure 6:
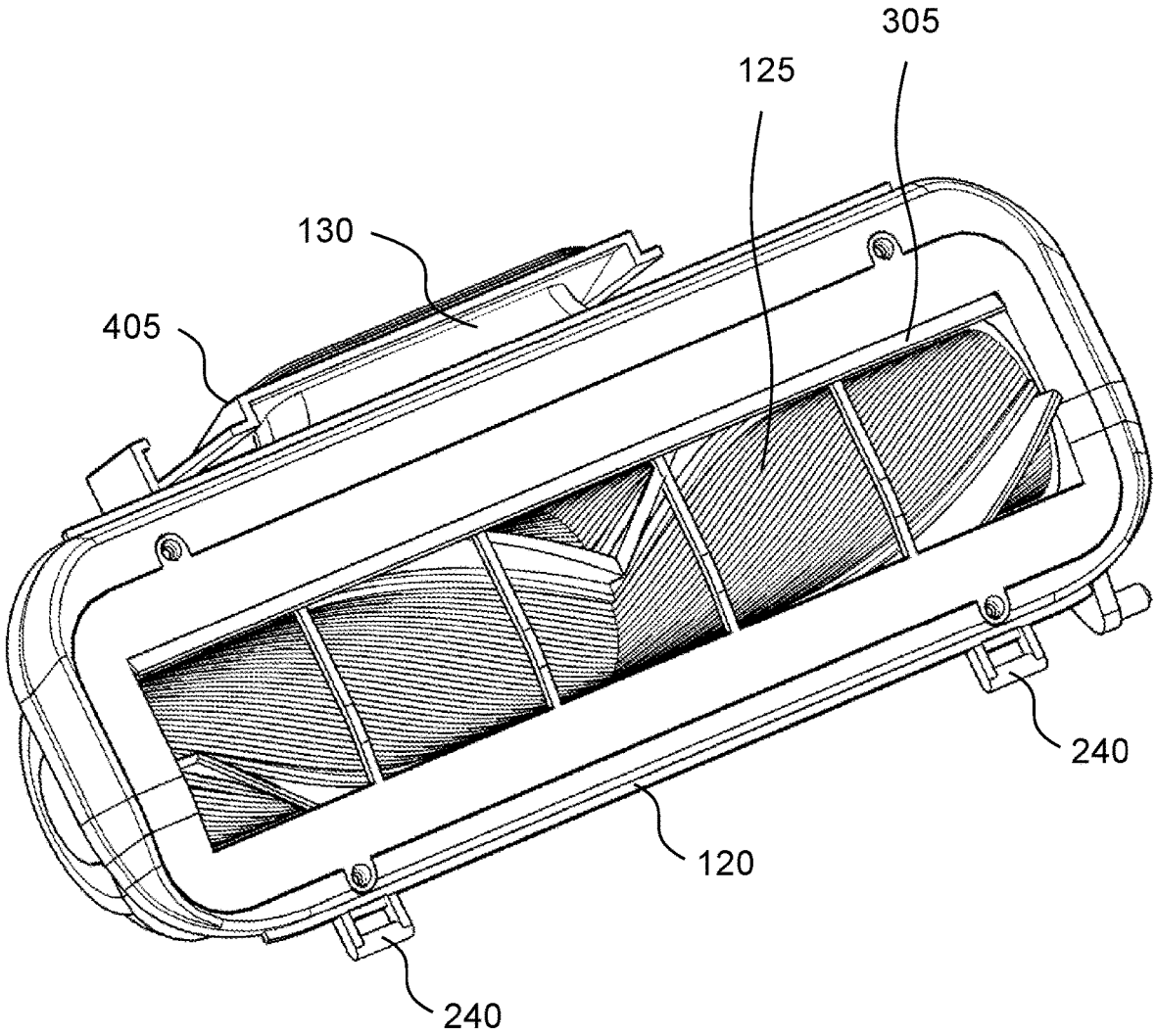
FIG. 6 shows a perspective view of a suction nozzle of a floor vacuum cleaner from below.

FIG. 6 shows a view of a suction nozzle 120 of a floor vacuum cleaner 100 from below. The brush roller 125 comprises by way of example double-helical wave-shaped patterns which are formed from rows of bristles. The chassis can be reinforced by ribs running longitudinally in an intake region of the suction nozzle 120.

The following is a summary list of reference numerals and the corresponding structure used in the above description of the invention:

100 Floor vacuum cleaner
105 Chassis

110 Chassis frame
115 Floor surface
120 Suction nozzle
125 Brush roller
130 Tubular connecting piece
135 Suction facility
140 Direction of travel
205 Transverse axis
210 Longitudinal axis
215 Height axis
225 First degree of freedom
230 Second degree of freedom
235 Third degree of freedom
240 Journal
245 Receiver
250 Resilient element
305 Sealing lip
310 Sliding element
405 Flange

The invention claimed is:

1. A floor vacuum cleaner for cleaning a floor surface, the floor vacuum cleaner comprising:

a chassis with a chassis frame for traveling on the floor surface, said chassis defining a longitudinal direction and a longitudinal axis;

a suction nozzle for an intake of an airflow at the floor surface;

said suction nozzle being mounted relative to said chassis by respective mounting arrangements at a front left and a front right of said chassis in a direction of travel, said mounting arrangements including a journal and a guide configured to enable a tilting of said suction nozzle about said journals, a pivoting of said suction nozzle about the longitudinal axis, and a vertical movement of said suction nozzle, but to prevent a movement of said suction nozzle in the longitudinal direction of said chassis.

2. The floor vacuum cleaner according to claim 1, wherein a journal of said mounting arrangement is provided on said suction nozzle and a guide of said mounting arrangement is provided on said chassis.

3. The floor vacuum cleaner according to claim 1, wherein said suction nozzle is mounted so as to be vertically movable at a rear left and rear right.

4. The floor vacuum cleaner according to claim 3, further comprising a resilient element disposed to bias a rear end of said suction nozzle into a predetermined vertical position relative to said chassis.

5. The floor vacuum cleaner according to claim 4, wherein said resilient element is formed by a resilient tubular connecting piece through which the airflow flows during an operation of the floor vacuum cleaner.

6. The floor vacuum cleaner according to claim 3, wherein a deflection of a rear end of said suction nozzle upwardly and downwardly from a predetermined position is limited in each case to a predetermined path.

7. The floor vacuum cleaner according to claim 1, wherein a deflection of the front end of the suction nozzle in an upward direction is limited to a predetermined value.

8. The floor vacuum cleaner according to claim 1, further comprising a brush roller attached in said suction nozzle, said brush roller having an axis of rotation running transversely to the direction of travel.

9. The floor vacuum cleaner according to claim 1, further comprising a sealing lip disposed in a region of a rear end of said suction nozzle.

10. The floor vacuum cleaner according to claim 1, further comprising a sliding element for supporting a rear end of said suction nozzle relative to the floor surface.

* * * * *